US006834472B2

(12) United States Patent
Kujubu et al.

(10) Patent No.: US 6,834,472 B2
(45) Date of Patent: Dec. 28, 2004

(54) PACKAGING SYSTEM

(75) Inventors: Eitaro Kujubu, Mihara (JP); Hiroshi Kondo, Mihara (JP); Wataru Kudo, Mihara (JP)

(73) Assignee: Furukawa Mfg. Co., Ltd., Tokyo (JP)

( * ) Notice: Subject to any disclaimer, the term of this patent is extended or adjusted under 35 U.S.C. 154(b) by 0 days.

(21) Appl. No.: 10/639,113

(22) Filed: Aug. 12, 2003

(65) Prior Publication Data

US 2004/0035087 A1 Feb. 26, 2004

(30) Foreign Application Priority Data

Aug. 26, 2002 (JP) ..... 2002-244620

(51) Int. Cl.[7] ..... B65B 57/02

(52) U.S. Cl. ..... 53/64; 53/255; 53/258; 53/260; 53/570

(58) Field of Search ..... 53/64, 251, 385.1, 53/284.7, 570, 571, 255, 258, 260, 261, 253, 276

(56) References Cited

U.S. PATENT DOCUMENTS

| | | | | | |
|---|---|---|---|---|---|
| 2,601,480 | A | * | 6/1952 | Victor | 53/370.2 |
| 3,503,180 | A | * | 3/1970 | Myles et al. | 53/258 |
| 3,552,090 | A | | 1/1971 | Roberts et al. | 53/71 |
| 3,721,062 | A | | 3/1973 | Roberts | 53/385 |
| 3,879,918 | A | * | 4/1975 | Lerner | 53/441 |
| 3,908,343 | A | | 9/1975 | Farrelly | 53/385 |
| 3,930,352 | A | * | 1/1976 | Carnes | 53/572 |
| 3,971,191 | A | * | 7/1976 | Hoyland | 53/512 |
| 4,147,012 | A | * | 4/1979 | van Mil | 53/468 |
| 4,248,032 | A | * | 2/1981 | Woods et al. | 53/570 |
| 4,432,188 | A | * | 2/1984 | Andrews | 53/436 |
| 4,553,376 | A | | 11/1985 | Okada et al. | 53/511 |
| 4,664,161 | A | | 5/1987 | Sawa et al. | 141/114 |
| 4,754,596 | A | * | 7/1988 | Yasumune et al. | 53/434 |
| 5,551,215 | A | * | 9/1996 | McDonald et al. | 53/459 |
| 5,692,360 | A | * | 12/1997 | McDonald et al. | 53/434 |
| 5,816,990 | A | | 10/1998 | Melville | 493/22 |
| 5,987,854 | A | * | 11/1999 | Killinger et al. | 53/459 |
| 6,516,587 | B1 | * | 2/2003 | Chikatani | 53/459 |

FOREIGN PATENT DOCUMENTS

| | | |
|---|---|---|
| JP | 49-72082 | 7/1974 |
| JP | 49-72082 | 9/1974 |
| JP | 57-37525 | 3/1982 |
| JP | 58-203827 | 11/1983 |

* cited by examiner

*Primary Examiner*—Rinaldi I. Rada
*Assistant Examiner*—Thanh Truong
(74) *Attorney, Agent, or Firm*—Kusner & Jaffe

(57) ABSTRACT

An article to be packaged and a packaging bag for covering the article are supplied to heat sealing mechanisms which arrive at uniform time intervals, in synchronism with cycle timing of the respective heat sealing mechanisms. A vertically openable beak-shaped hopper and a sliding plate perform reciprocal movement at a uniform time interval along guides on both sides, and arrive at circulating sealing platforms. The hopper is inserted into an opening of the packaging bag hanging down from above, and conveys the packaging bag to the sealing platform whilst extending the same. In response to a relevant signal, a forward-and-reverse motor coupled to a ball screw causes the article to advance following the hopper by an insertion rod moving along the guides. If there is no resistance of the packaging bag on the opening-and-closing bars which open to opposite sides, a packaging bag absence signal is issued, and according to this signal, the insertion rod is withdrawn together with the hopper, leaving the article on the sliding plate, and subsequent advance timing of the hopper is controlled.

7 Claims, 19 Drawing Sheets

PACKAGING SYSTEM

TECHNICAL FIELD

The present invention relates to a packaging system comprising an article-to-be-packaged supplying device for supplying articles to be packaged and a packaging bag for covering the articles, to heat sealing mechanisms which arrive at uniform time intervals, in synchronization with the cycle timing of the respective sealing mechanisms.

BACKGROUND ART

When, for example, an article to be packaged such as a slab of chicken or a slab of beef, which has had the feathers or skin treated in scalding water, is mechanically packed, in general, the opening of the topmost packaging bag of stacked bags is picked up by a vacuum cup and is caused to open by blowing compressed air into the bag, the bag opening is then stretched over a beak-shaped hopper, and the article is pushed and filled into the bag by passing inside the beak-shaped hopper, as disclosed in JP49-72082A and JP58-203827A. However, the operation of picking up bag openings repeatedly by means of a vacuum cup, against the weight of the bag, necessarily involves the problem of bag opening errors. In other words, although the weight of the bag itself is not a problem, since the bag is stretched like a sail by the air flow and the weight of the bag is added to this, then bag opening errors due to the vacuum cups occur.

In contrast to the prior art examples described above, JP57-37525A (U.S. Pat. No. 4,553,376) discloses a device wherein the end of a continuous tube of film is opened up by a pair of vacuum cups, whilst the film is drawn but, an article to be packaged is conveyed inside the film from the open end thereof, and the film containing the article is then cut to a prescribed length, whereupon the cut film and the article are conveyed together to a seal mechanism. In this device, the tube film opening end and the sealing mechanism are placed opposing each other, and the device inherently involves a two-way motion of the article, namely, a first movement inside the tube film, and then a movement of the article and the tube film together, into the sealing mechanism, and hence there is a problem in terms of efficiency.

DISCLOSURE OF THE INVENTION

The present invention discloses a packaging system comprising an article-to-be-packaged supply device for accommodating an article to be packaged mechanically in a packaging bag, and conveying the article together with a packaging bag, to a rotary vacuum packaging machine, for example, at a good rate of efficiency. The packaging system according to the present invention discloses a sequenced mechanism which eliminates wasted space inside packaging bags, even in the case of bag opening errors or indefinite articles to be packaged, and moreover a mechanism for unmanned operation. The composition of the present invention is a packaging machine wherein a portion of a winding path of a taped bag formed by attaching the openings of respective bags stacked in a scale-like fashion onto an adhesive tape, is formed horizontally, the opening of the foremost packaging bag hanging down from the adhesive tape in the horizontal portion of the travel path is pulled downwards and opened by vacuum cups, a beak-shaped hopper which opens in the upward and downward direction is inserted inside the opening of the packaging bag, the packaging bag is peeled off from the adhesive tape, and furthermore, an article to be packaged is accommodated inside the packaging bag via the hopper by means of an insertion rod which follows the course of the hopper, the opening of the packaging bag being sealed when the packaging bag has been placed in a vacuum state by means of a rotary vacuum packaging machine; wherein it comprises: means for limiting the amount of movement of the respective front ends of the hopper and the insertion rod to a position up to the inner side of a circulating sealing platform; means for restricting the sliding motion of the packaging bag by pressing the bag opening against the hopper by means of a frictional element which presses on the under side of the hopper; means for blowing compressed air injected onto the upper face of the hopper, inside the packaging bag along the upper face of the hopper, and also blowing same inside the packaging bag via the interior of the hopper as the hopper advances; and means for advancing a pair of opening and closing bars provided below the hopper, together with the hopper to the limit region, and temporarily standing by in the region after the hopper has been withdrawn, and causing the opening of the packaging bag to be stretched along the sealing platform by opening in the opposite directions with the aforementioned standby period.

The opening of the foremost packaging bag hanging down from the adhesive tape tends to open automatically due to the effects of gravity, and since a structure is adopted wherein the openings of the packaging bags are pulled downwards by vacuum cups, opening errors are reduced in advance, even if there is an air flow acting on the packaging bags. Moreover, by adopting means for blowing compressed air injected onto the upper face of the hopper inside the packaging bag, using the angle of incidence of the upper face of the hopper, and also blowing the air into the packaging bag via the interior of the hopper, as the hopper advances, the packaging bags are opened in an efficient manner and the insertion of the hopper is performed reliably.

By adopting means for restricting the movement of the respective ends of the hopper and insertion rod, to the inner side of the circulating sealing platform, the rear end of the article inserted with the packaging bag is restricted to the inner side of the sealing platform, and consequently, no wasted space is formed inside the packaging bag, and moreover, by adopting means for restricting the sliding motion of the packaging bag by pressing the bag opening against the hopper by means of a frictional element which presses on the under side of the hopper, scattering of the article due to the pushing momentum is reduced, and no wasted space is formed inside the packaging bag.

BEST MODE FOR CARRYING OUT THE INVENTION

Figure 1:
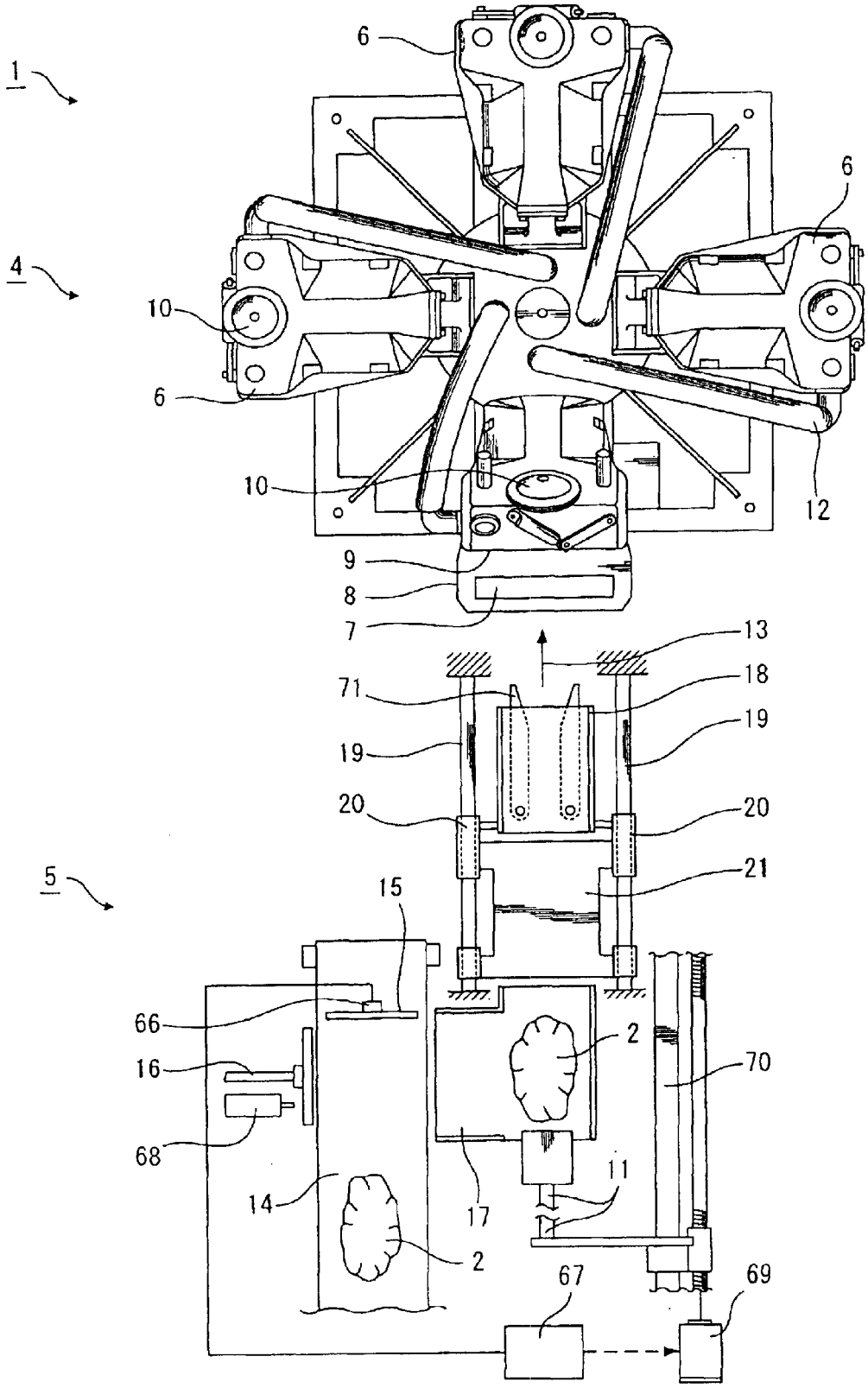
FIG. 1 is a plan view.
Figure 2:
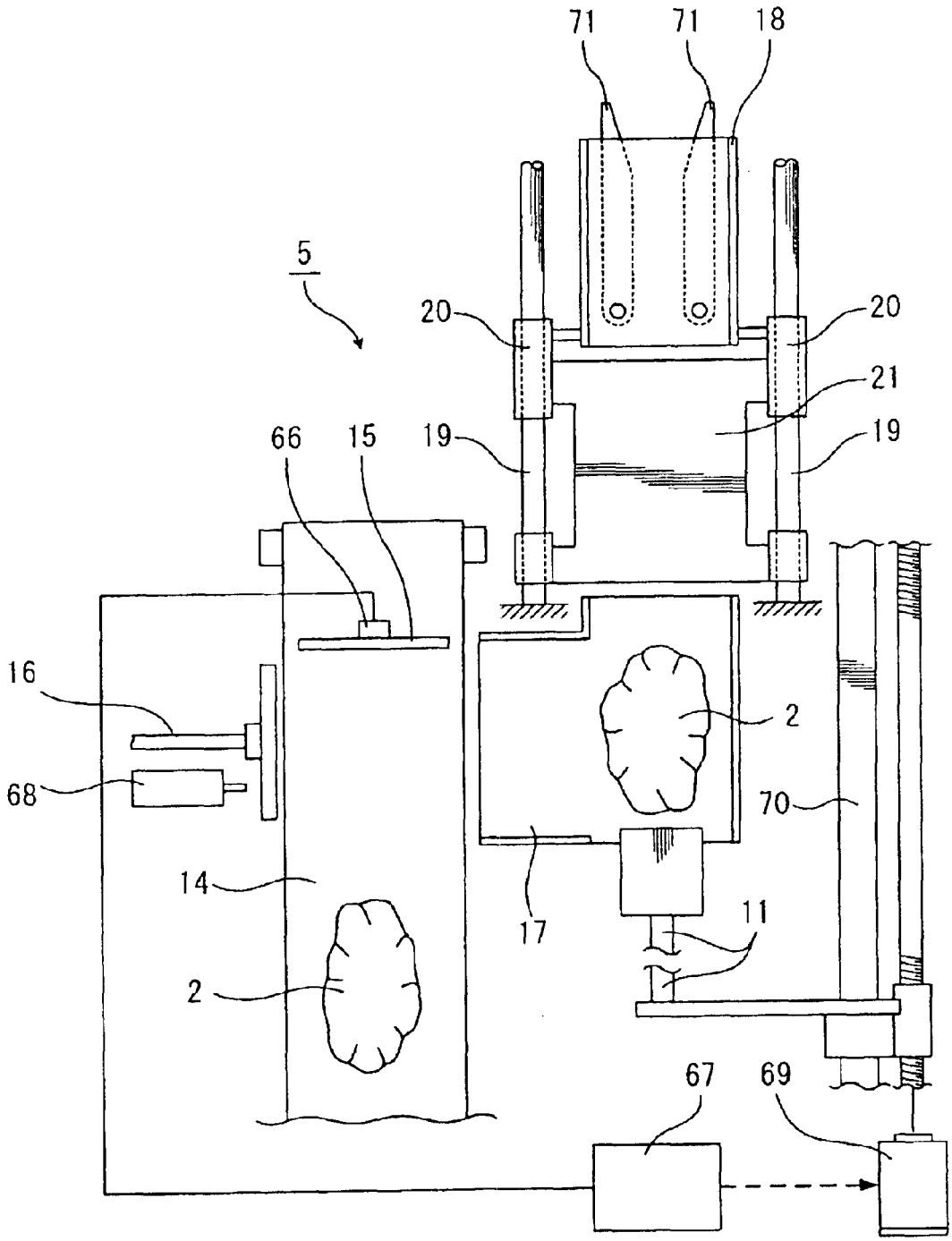
FIG. 2 is an enlarged view of FIG. 1.

FIG. 1 is a plan view of the whole of a packaging system. This packaging system 1 comprises a rotary vacuum packaging machine 4 which seals packaging bag containing an article to be packaged, in a vacuum state, and an article-to-be-packaged supplying device 5 for accommodating the article inside a packaging bag.

The rotary vacuum packaging machine 4 comprises four pressure chambers 6 which rotate intermittently through 90° per rotation. These pressure chambers 6 each comprise a fixed plate 8 on which a sealing platform 7 is installed, and a lid member 9 which is disposed openably and closably with respect to the fixed plate 8. A sealing bar operated by a cylinder and diaphragm 10 is provided inside the lid member 9. A suction pipe 12 is connected to the lid member 9 and air is suctioned out of the pressure chamber 6 by means of a vacuum pump.

Packaging bag containing the article is mounted onto the fixed plate 8 from direction indicated by arrow 13 in FIG. 1, whereupon the air inside the pressure chamber 6 is sucked out via the suction pipe 12, whilst rotating the pressure chamber 6 in a clockwise fashion, and a vacuum is applied to the packaging bag containing the article. Thereupon, when the interior of the packaging bag has reached a vacuum state, the opening of the packaging bag is heat sealed with a sealing bar.

The article-to-be-packaged supplying device 5 is a device for conveying a packaging bag containing the article to the sealing platform 7 of the opened pressure chamber 6, in the direction of the arrow 13 in FIG. 1.

The article-to-be-packaged supplying device 5 comprises a belt conveyor 14 for conveying the article 2, an end stopper 15 being provided at the very end of the belt conveyor 14, for stopping the article 2. Adjacently to the belt conveyor 14, there is positioned a loading table 17 onto which the article 2 is pushed and mounted by a conveyor element 16. A pushing bar 11 for pushing the article 2 into a beak-shaped hopper 18 is provided to the rear of the loading table 17.

The beak-shaped hopper 18 is provided at the front end of a sliding plate 21 which is held via sliders 20 on two parallel guides 19, and is constituted in such a manner that it performs reciprocal movement along the guide 19 according to a uniform cycle at all times.

Figure 3:
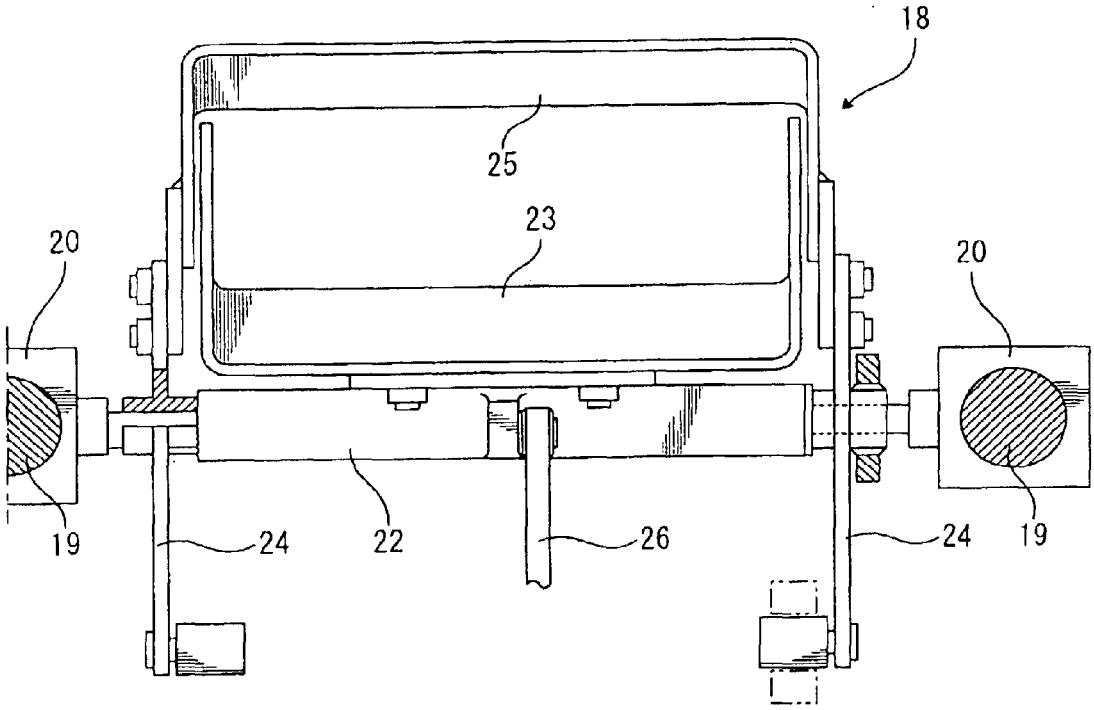
FIG. 3 is a front view of a beak-shaped hopper.

FIG. 3 shows a detailed view of the beak-shaped hopper 18. This hopper 18 comprises a lower groove member 23 the front end of which is fixed to an axle bar 22 which is spanned between respective sliders 20, and an upper groove member 25 fixed to first levers 24 which support either end of the axle bar 22. By operation of a rod 26, the lower groove member 23 can be rotated and operated integrally with the axle bar 22, whilst the upper groove member 25 is rotated by operation of the first levers 24, thereby allowing the beak-shaped hopper 18 to be opened and closed in an upward and downward direction by the respective rotational operations.

Figure 4:
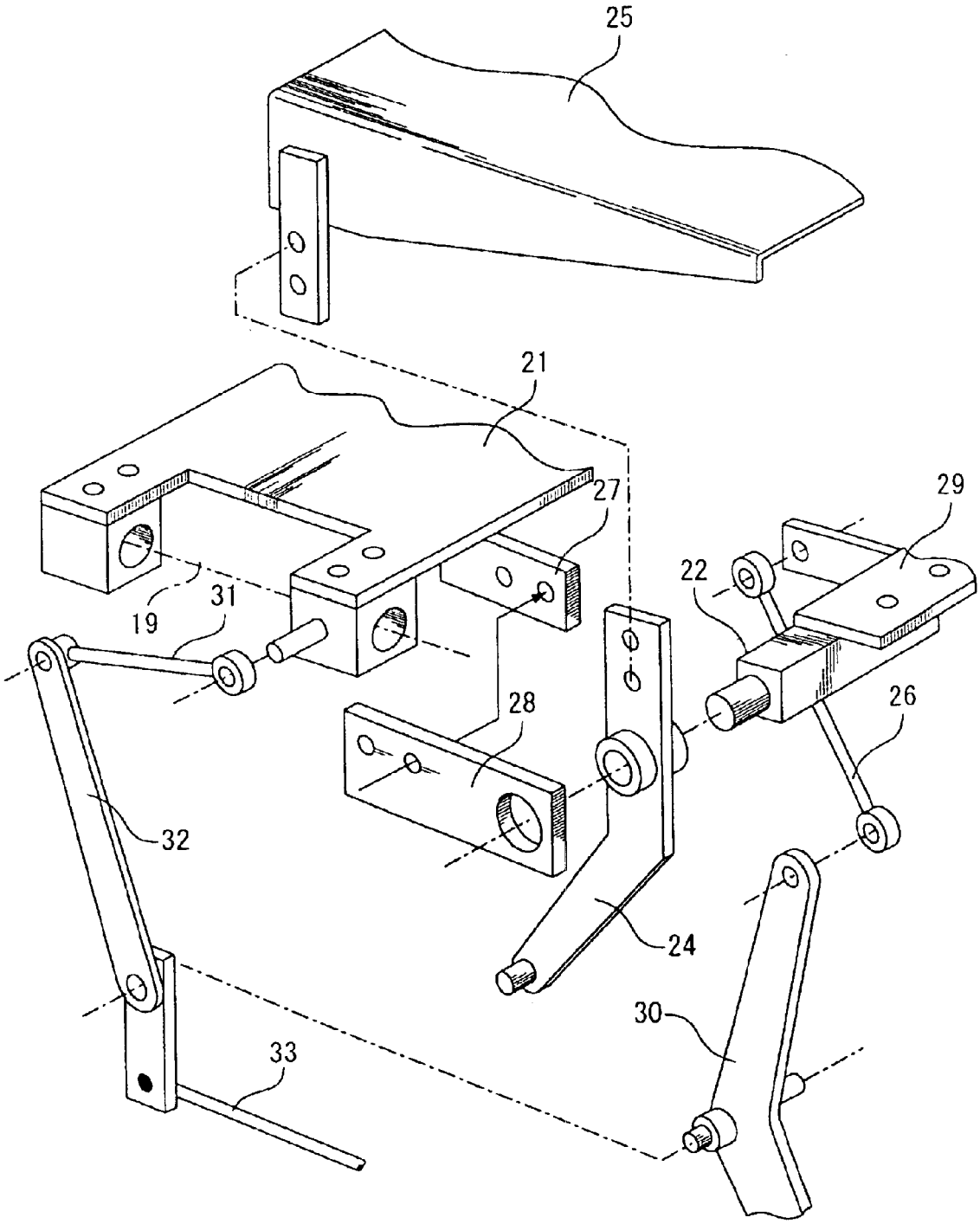
FIG. 4 is an analytical diagram of a beak-shaped hopper section.

More specifically, as shown by the partial exploded diagram in FIG. 4, a fixed plate 27 is installed on the front end of the sliding plate 21 which is supported on the parallel guides 19, an axle bearing plate 28 is installed on this fixed plate 27, and the aforementioned axle bar 22 is supported on this axle bearing plate 28. The lower groove member (not illustrated) fixed to the washer plate 29 of the axle bar 22 is able to rotate by means of the operational force of a second lever 30 being transmitted thereto via a rod 26. Moreover, the upper groove member 25 installed on the first levers 24 supported rotatably on either end of the axle bar 22 is caused to rotate upwards and downwards by means of the first levers 24, as described previously. When the operational force from a rod 33 is applied to a third lever 32 coupled to the sliding plate 21 by means of a rod 31, then the sliding plate 21 and the upper and lower groove members 23, 25 of the beak-shaped hopper are caused to move reciprocally along the parallel guides 19. In short, as shown in FIG. 6, the beak-shaped hopper 18 performs a repeated reciprocal motion, whereby it advances along the parallel guides 19 to the position 18U indicated by the dotted lines, in other words, to the sealing platform 7 on the fixed plate 8, and then retreats again to its original position.

Figure 6:
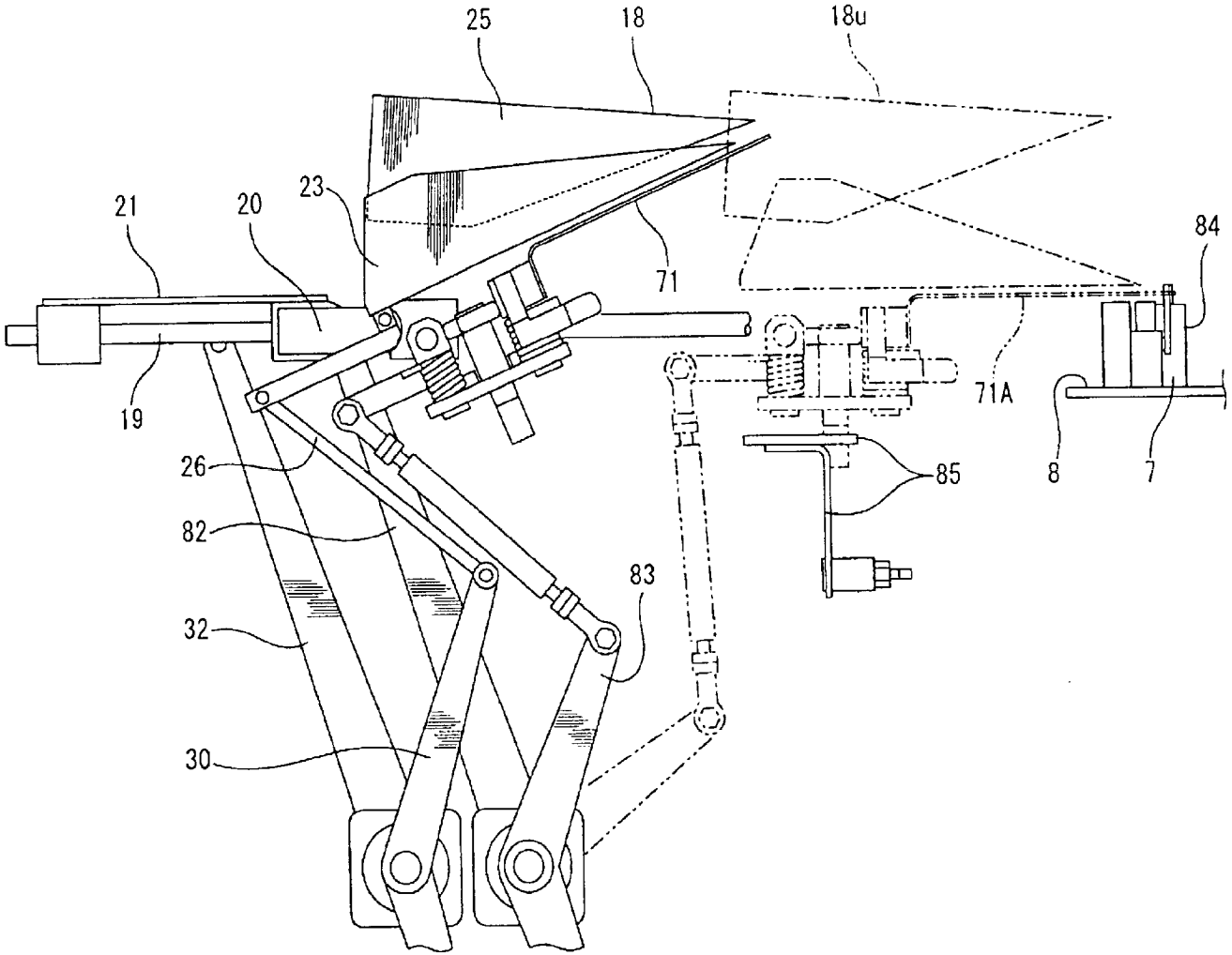
FIG. 6 is an illustrative diagram of the operating mechanism of a beak-shaped hopper and opening and closing bars.

In FIG. 6, the third lever 32 governs the reciprocal movement of the beak-shaped hopper 18, and the second lever 30 governs the upward and downward rotation of the lower groove member 23.

Figure 5:
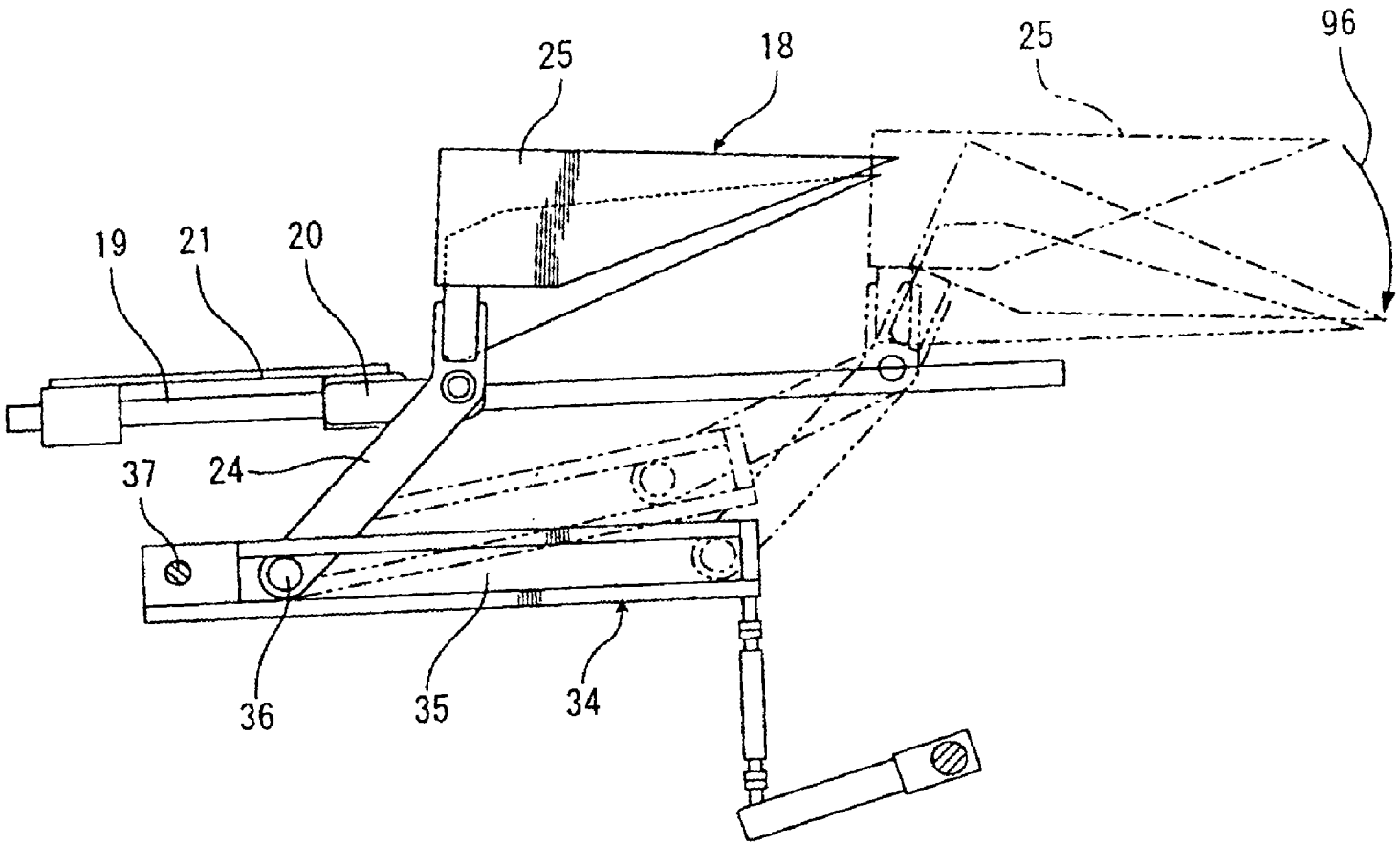
FIG. 5 is a diagram of the relationship between a beak-shaped hopper and a cam rail.

As shown in FIG. 5, since a pinhole 36 of the first lever 24 is coupled to a slit 35 of a cam rail 34, the attitude of the upper groove member 25 can be adjusted by inclination of the cam rail 34. The upward and downward operation cycle of the cam rail 34, which has a pin 37 forming an example at one end thereof, is described hereinafter.

Figure 7:
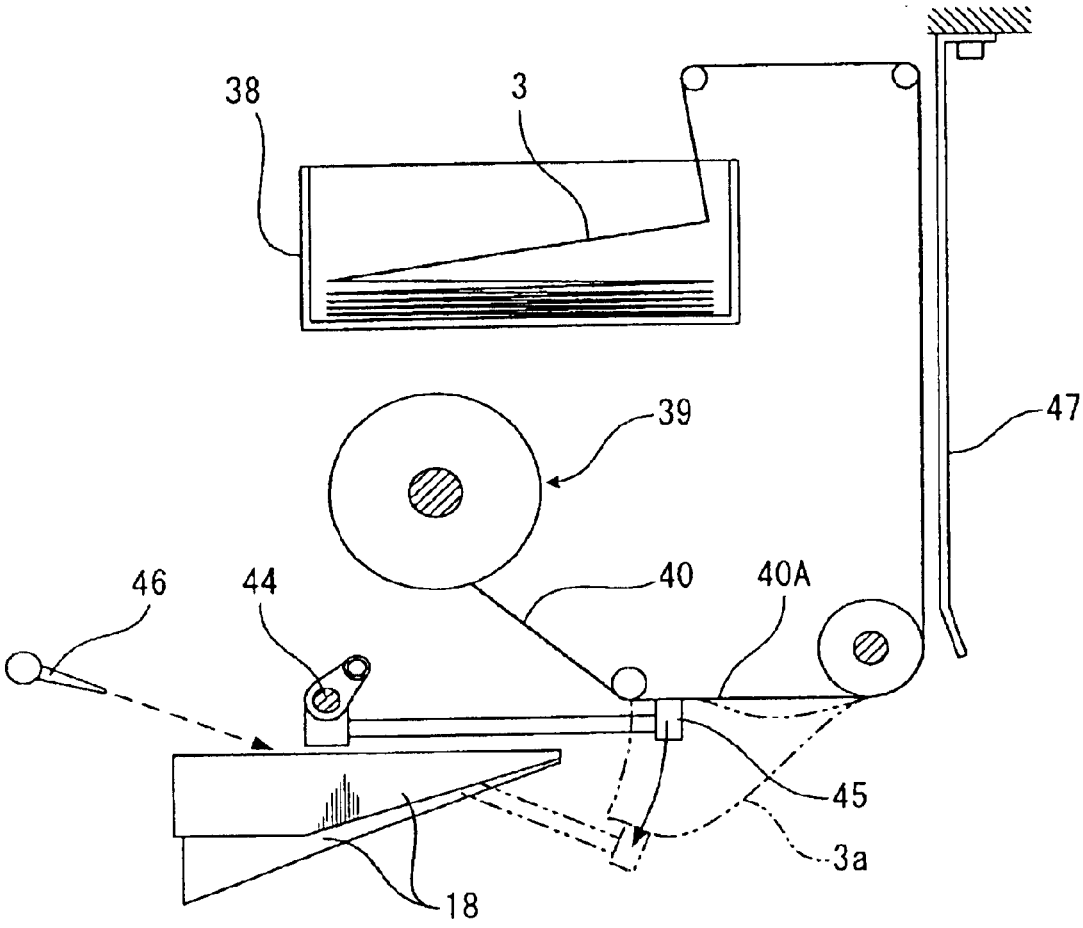
FIG. 7 is an illustrative diagram of a packaging bag opening.
Figure 8:
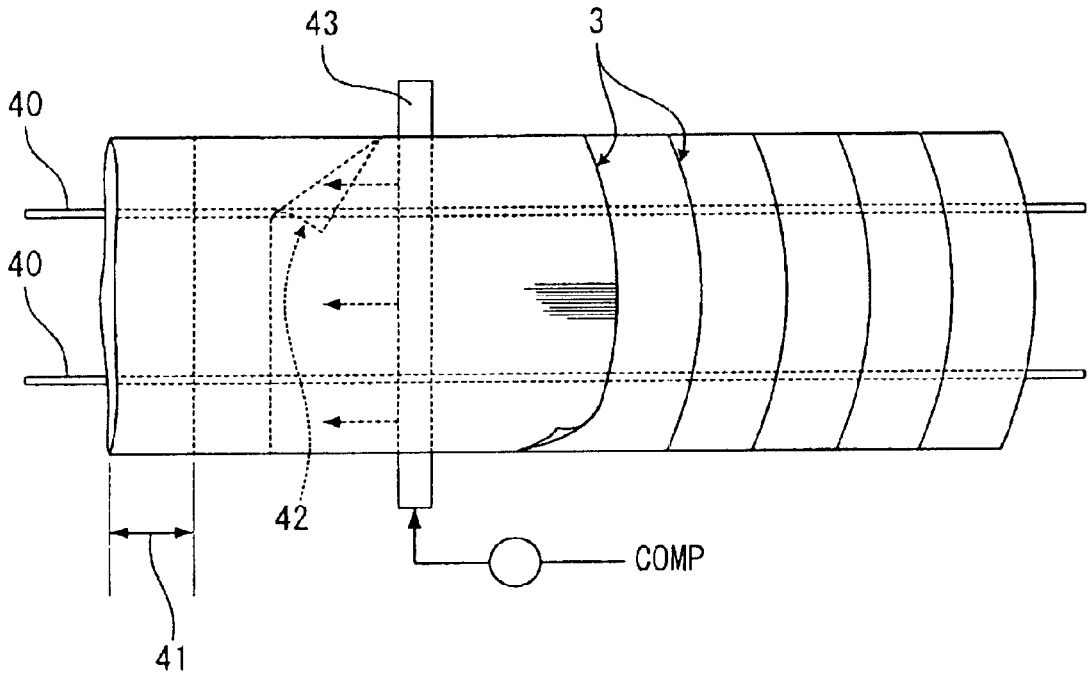
FIG. 8 is a plan view of a taped bag.

FIG. 7 is a compositional view showing a packaging bag supply section, wherein a box 38 disposed above the beak-shaped hopper 18 contains a taped bag of packaging bags comprising a plurality of packaging bags 3 which are mutually folded and stacked in a scale-like fashion, each of the packaging bags 3 being extractable by means of movement of an adhesive tape 40 caused by winding of a reel 39. As shown in FIG. 8, the aforementioned taped bag comprises packaging bags 3 folded in a scale-like fashion, the openings of each bag being connected together at prescribed intervals 41, by two pieces of adhesive tape 40. In spite of the illustration here, the number of pieces of adhesive tape 40 is not limited to two, but may be one or three or more. In this case, the end 42 of the folded packaging bag 3 is corrected into position by air pressure blown from a pipe nozzle 43 provided in the path of travel.

In the horizontal tape travel path 40A illustrated in FIG. 7, the opening of the foremost packaging bag 3 hanging down from the adhesive tape 40 has a tendency to open naturally due to its own weight, as indicated by the dotted lines 3*a*. Therefore, when the bag opening suctioned up by a vacuum cup 45 working about a suspended rotating axle 44 as a fulcrum is opened up in the downward direction, as illustrated by the arrow, the advancing beak-shaped hopper 18 is inserted inside the packaging bag 3 and is released. Consequently, control is exercised beforehand in such a manner that the feed pitch of the respective packaging bags 3 matches the reciprocal movement cycle of the beak-shaped hopper 18. In this case, compressed air output by a nozzle 46 disposed at an inclined angle as illustrated in FIG. 7 is caused to act on the opening section of the packaging bag 3, along the upper face of the beak-shaped hopper 18, whereupon the compressed air is then blown into the packaging bag 3 via the cavity in the advancing-hopper 18. A pressing guide 47 serves to hold the lower edges of the superimposed packaging bags, in such a manner that they do not become scattered.

Figure 9:
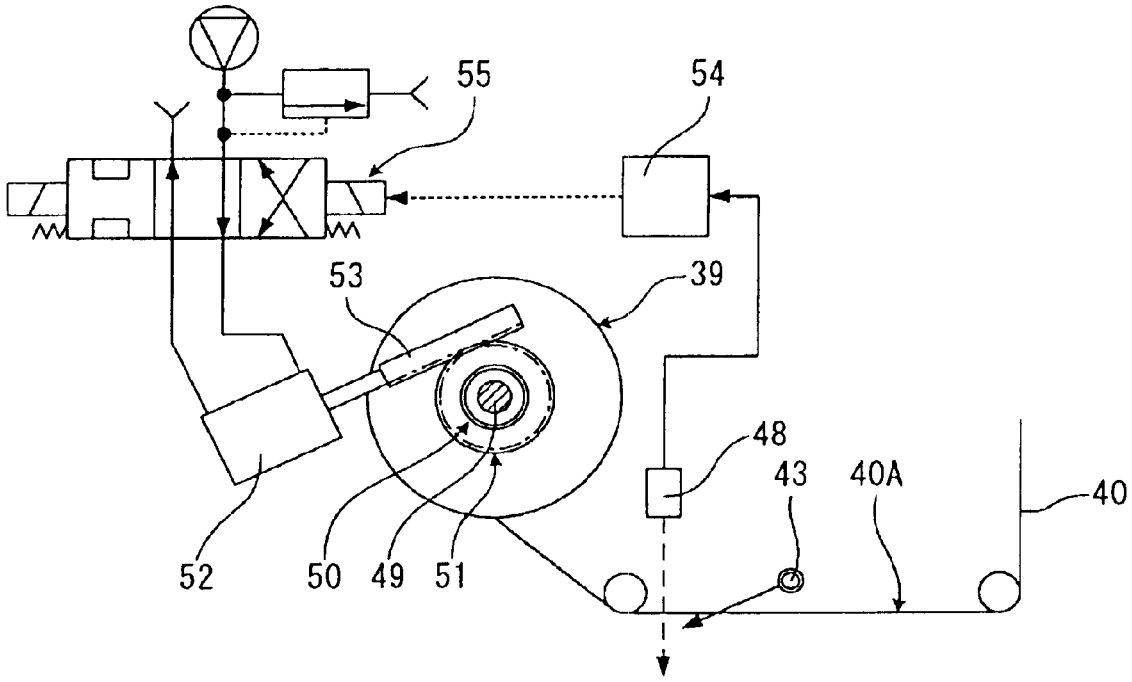
FIG. 9 is an illustrative view of a winding device of the taped bag.

In the horizontal tape travel path 40A of the adhesive tape 40 shown in FIG. 9, a sensor 48 for halting the front end of the packaging bag 3 in a designated position is provided. A ratchet wheel 51 incorporating a one-way clutch 50 is disposed between the reel 39 and the supporting shaft 49 thereof, and a rack tooth gear bar 53 coupled to a motor 52 comprising an air cylinder drive the aforementioned ratchet wheel 51, thereby causing the reel 39 to perform an inching rotation in one direction only. In short, since an operating device 55, such as an electromagnetic switching valve, is activated by a signal from a control device 54, and the motor 52 causes the reel 39 to move in an inching rotation, the rotation of the reel 39 is halted simultaneously with the time at which the sensor 48 catches the front end of the packaging bag 3. In other words, if the operations are depicted in the form of a flowchart, then they would correspond to the relationship between steps (S1) and (S2) in FIG. 19, and the corresponding control ensures that a uniform amount of the beak-shaped hopper 18 is inserted into the packaging bag 3 illustrated in FIG. 10.

Figure 11:
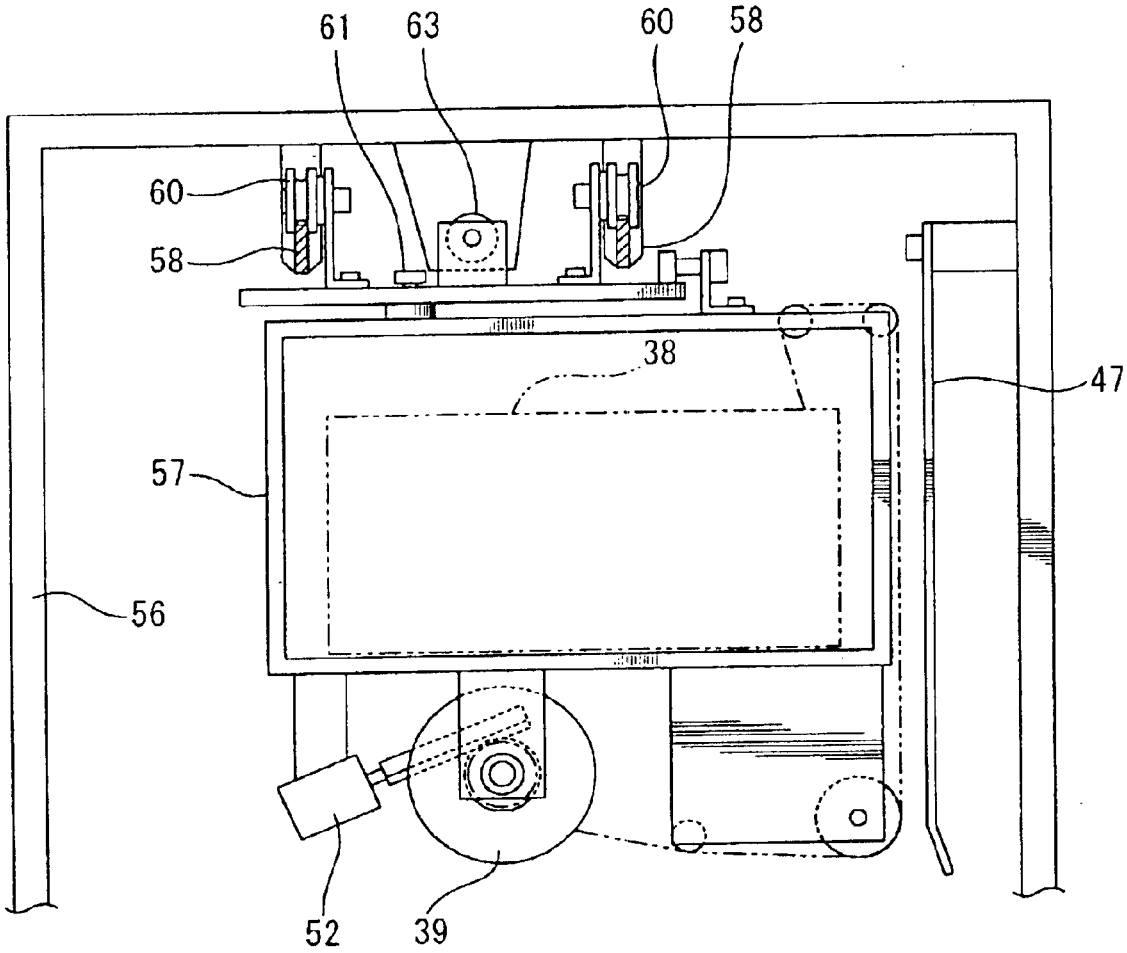
FIG. 11 is a side view of a taped bag accommodating device.

The box 38 containing the aforementioned taped bag in FIG. 11 is put inside a case 57 held in a frame 56. Supporting plates 59 having a shape of two overlapping arches, are suspended movably by four sliding carriages 60 from two rails 58 (see FIG. 12) fixed to the upper portion of the frame 56, and a set of two cases 57 is suspended respectively via an axle 61 for every pair of supporting plates 59. In order to align the centre of the two cases 57 with the path of travel 62 of the hopper into the packaging device, these two cases 57 can be displaced along the rails 58, together with the supporting plates 59.

The movement of the aforementioned supporting plates 59 is performed by operation of an operating device 63, such as a fluid cylinder, for example. Moreover, the two cases 57 are free to rotate respectively about axles 61, and when the bags in one of the cases have run out, the supporting plates 59 are moved, as indicated by the dotted line 59A, and the case 57A is rotated about axle 61A, thereby replenishing the bags.

Figure 12:
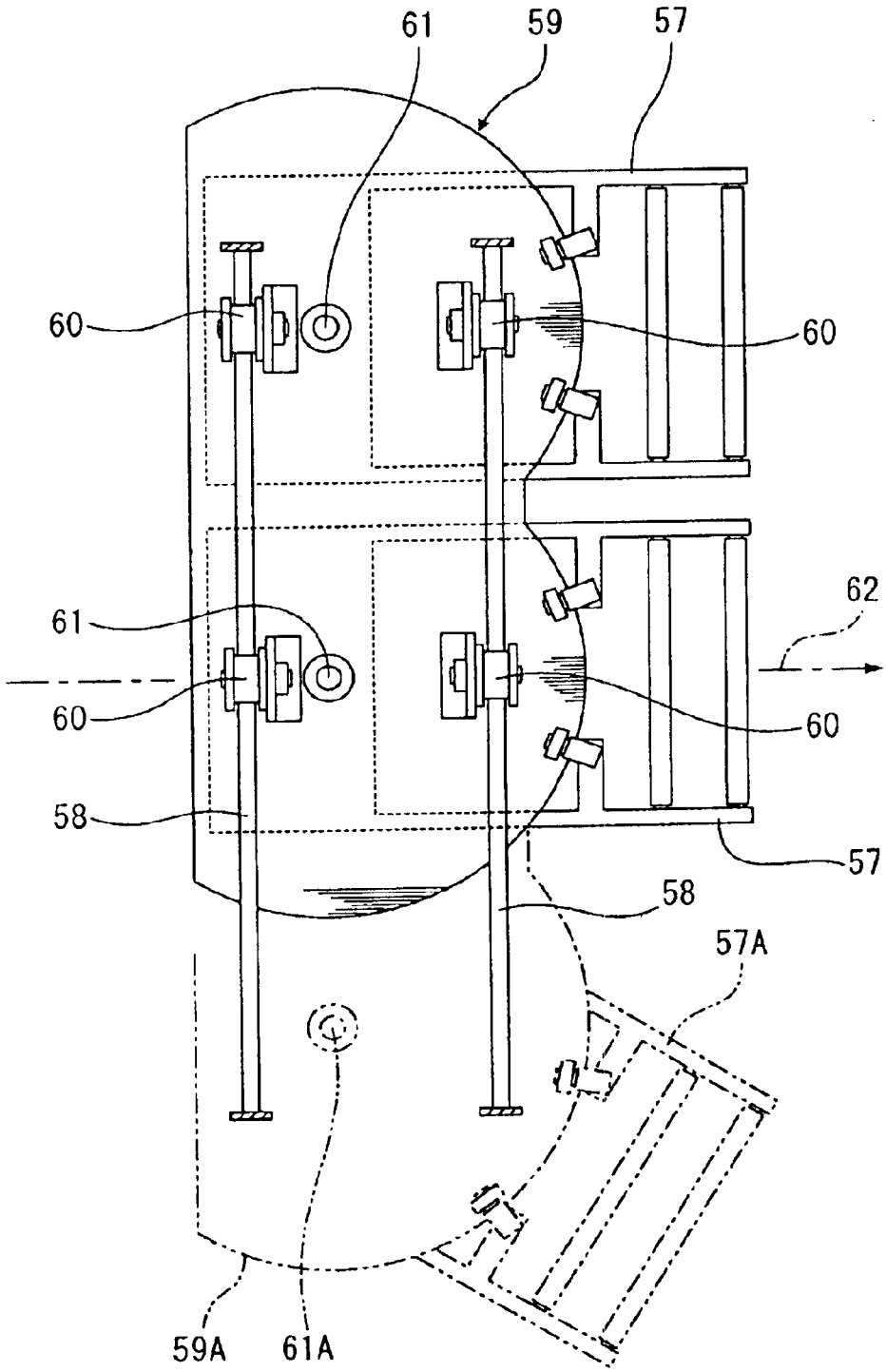
FIG. 12 is a plan view of FIG. 11.
Figure 19:
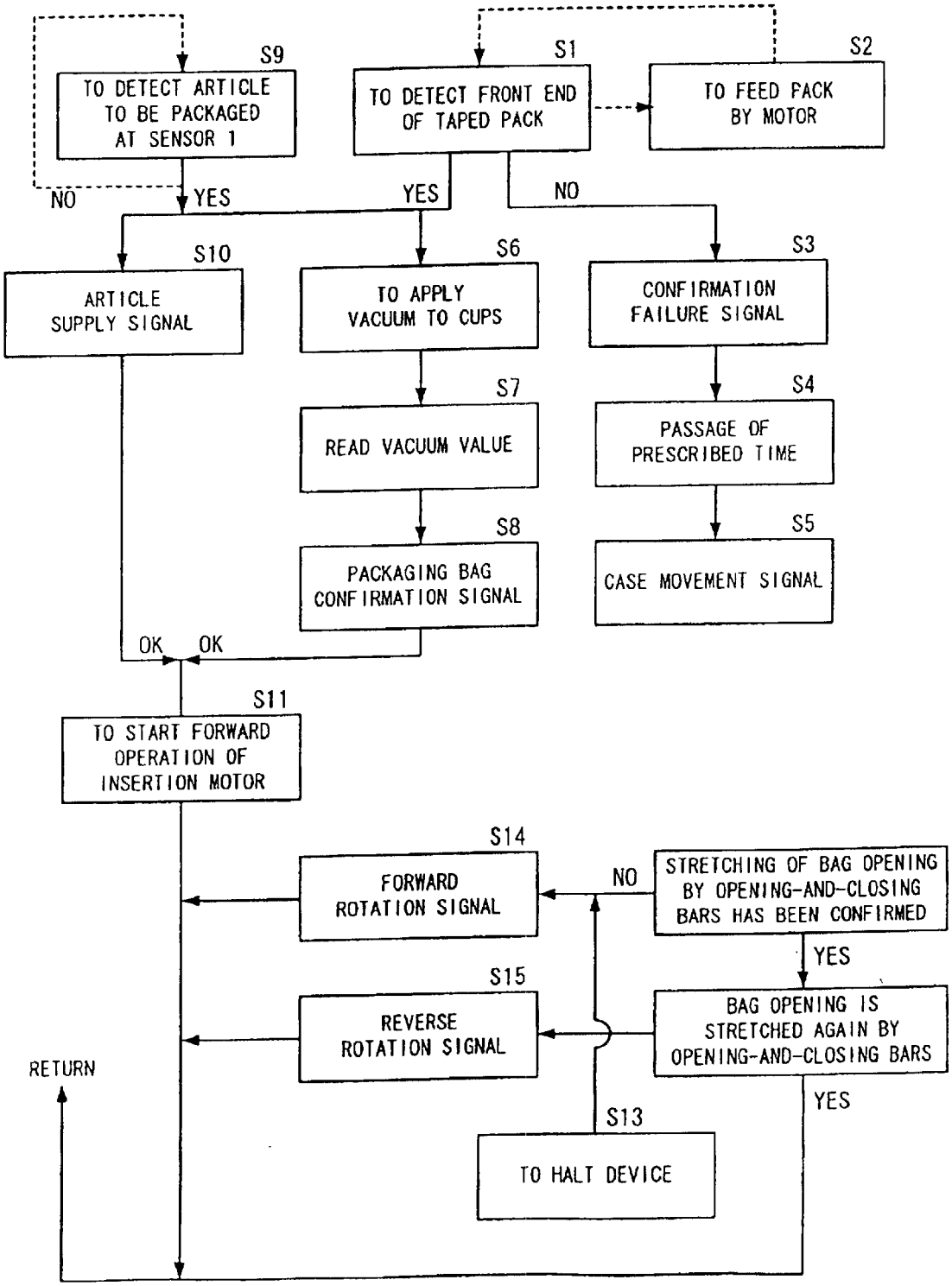
FIG. 19 is an illustrative view of a flowchart.

If an confirmation failure signal (S3) is issued indicating that the front end of the taped bag could not be confirmed, as in step (S3) in FIG. 19, and if this state continues for a set period of time (S4), then an operation is performed for switching the case 57 in the path of travel 62 into the packaging device in FIG. 12, from one case to the other case (S5). In other words, the operating device 63 such as the cylinder in FIG. 11 is operated, and the position of the two cases 57 in FIG. 12 is switched.

Figure 13:
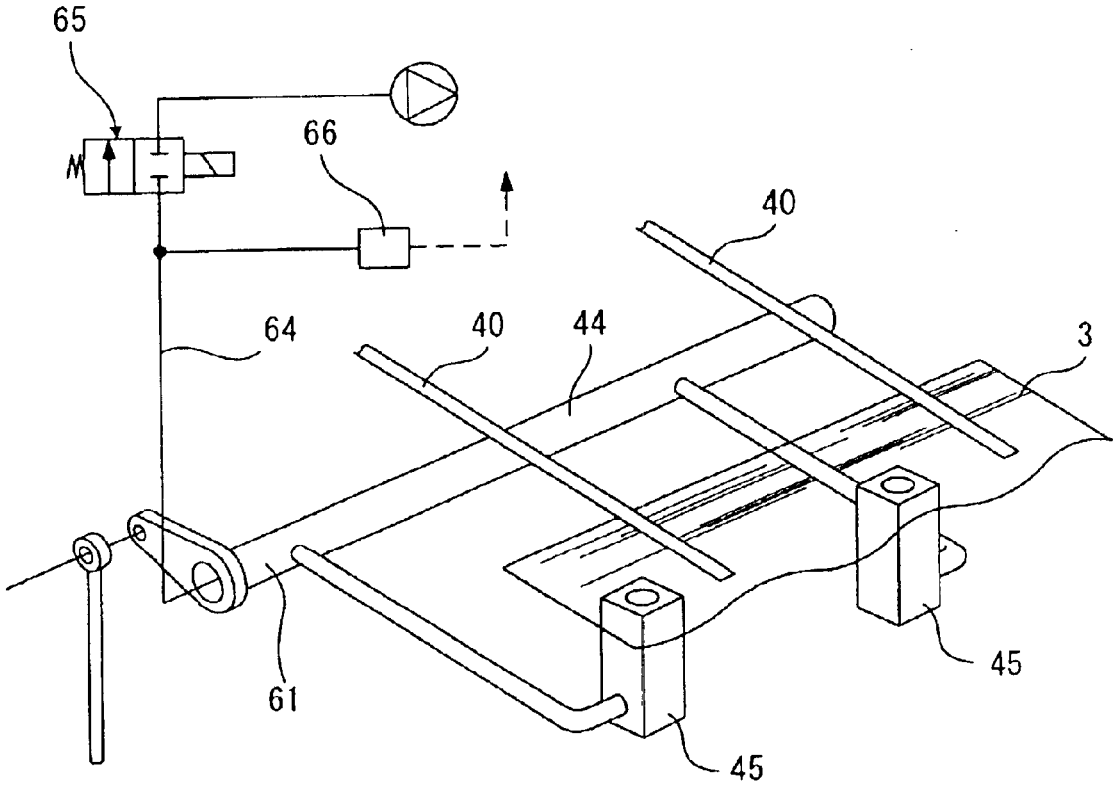
FIG. 13 is an illustrative view of a packaging bag opening device.

Meanwhile, as shown in FIG. 13, vacuum cups 45 are provided at prescribed intervals on a suspended rotating axle 44, and a vacuum line 64 is coupled to the suspended rotating axle 44. An electromagnetic switching valve 65 of the vacuum line 64 is controlled by a control device (not illustrated), and each time a packaging bag 3 arrives, a vacuum suction force is applied to the vacuum cups 45 and the packaging bag 3 is suctioned thereby. In other words, a vacuum suction force of applied to the vacuum cups 45 each time the sequence arrives at step (S6) in FIG. 19, and when the measured vacuum value as indicated by a vacuum gauge 66 in step (S7) reaches a set value, the packaging bag confirmation signal is issued in step (S8).

A first sensor 66 disposed on an end stopper 15 of the belt conveyor 14 in FIG. 1 detects an article to be packaged 2 which confronts and halts at the end stopper 15. When this detection signal is input to the control device 67, at a signal from the control device 67, the conveyor element 16 linked to an motor device 68 supplies the article 2 onto a loading table 17. This relates, in other words, to the steps (S9) and (S10) in FIG. 19.

As described above, in FIG. 19, by connecting the packaging bag 3 confirmation signal (S8) and the article-to-be-packaged supply signal (S10), a start forward rotation (S11) of the insertion motor is performed. In other words, in FIG. 1, the control device 67 drives a forward rotation motor 69 which is coupled to a screw bar, and by the movement of an insertion bar 11 along a guide 70, the article 2 is caused to move towards the advancing hopper 18.

Figure 14:
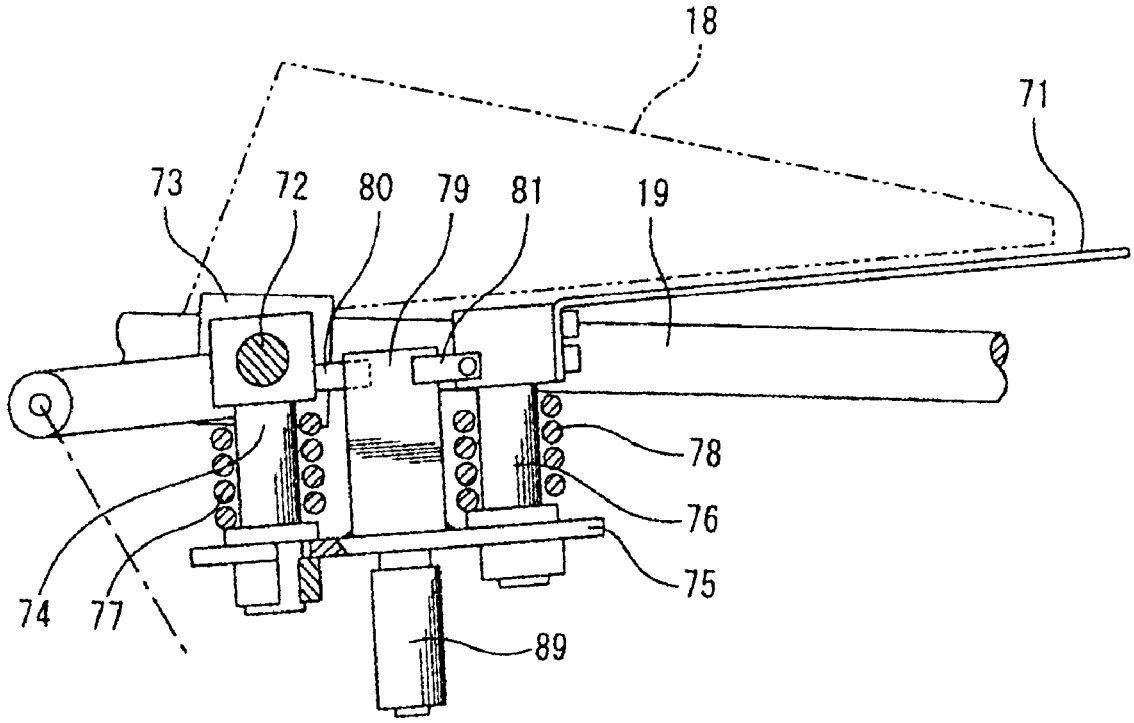
FIG. 14 is a side view of opening and closing bars.
Figure 15:
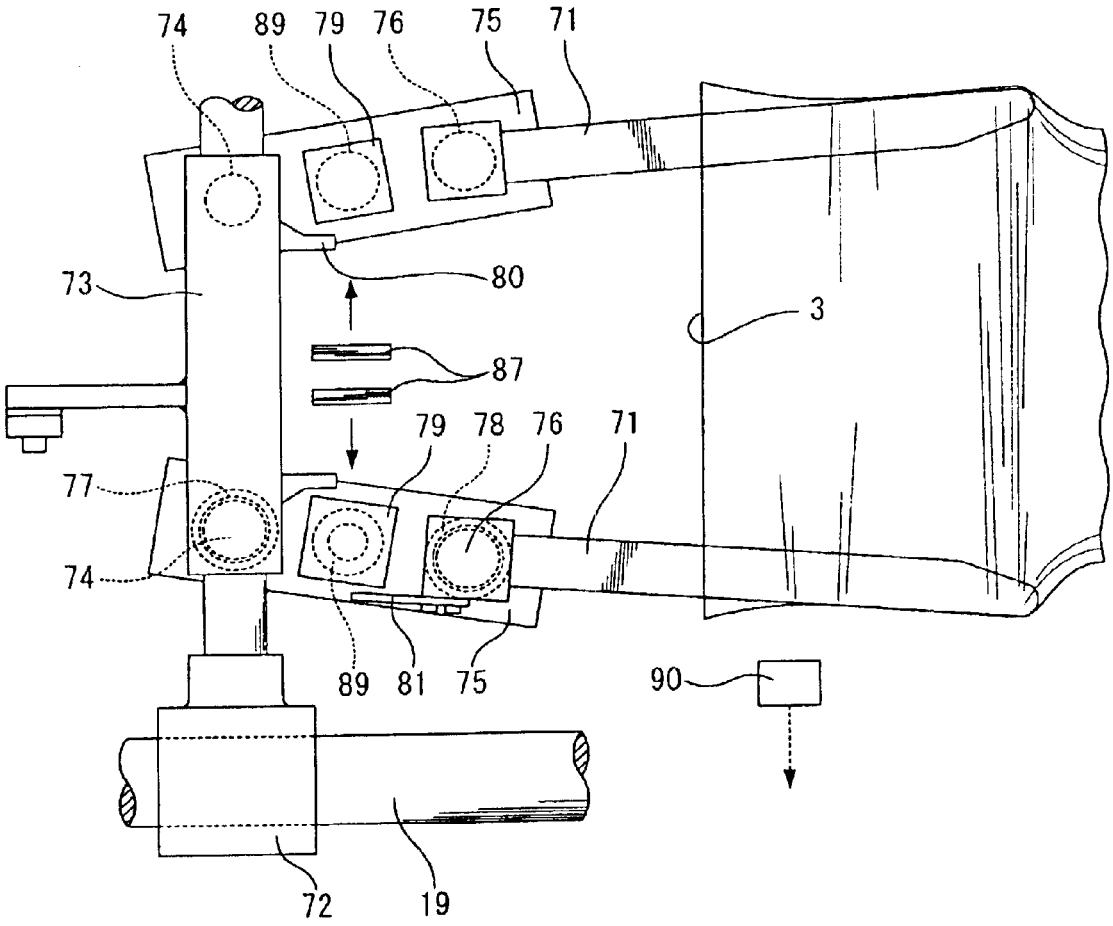
FIG. 15 is a plan view of FIG. 14.

FIG. 14 and FIG. 15 show the details of an opening and closing bar 71 disposed beneath the beak-shaped hopper 18 illustrated in FIG. 6. The opening and closing bars 71 are completely separated from the hopper 18, and are installed on a spanning shaft 73 which extends rotatably between sliders 72 supported respectively on the parallel guides 19 on either side, as described below. In other words, two spindles 74 are suspended from the aforementioned spanning shaft 73, the rear ends of rotating plates 75 are supported respectively on the lower ends of these spindles 74, and the aforementioned opening and closing bar 71 is fixed respectively to the heads of vertical axles 76 supported rotatably on the front ends of the respective rotating plates 75.

The torsion coil springs 77 wound about the two spindles 74 in the diagram impart a force which opposes the rotation of the rotating plates 75 in the open direction, and the torsion coil springs 78 wound about the vertical axles 76 impart a force which opposes the rotation of the opening and closing bars 71 in the closing direction. A post member 79 is formed in the upward direction from the dead centre of the rotating plate 75, and stoppers 80 and 81 confront this post member 79, thereby receiving the reaction of the aforementioned torsion coil springs 77, 78. The aforementioned mechanism maintains the opening and closing bars 71 in a parallel attitude, as illustrated in FIG. 1.

Figure 16:
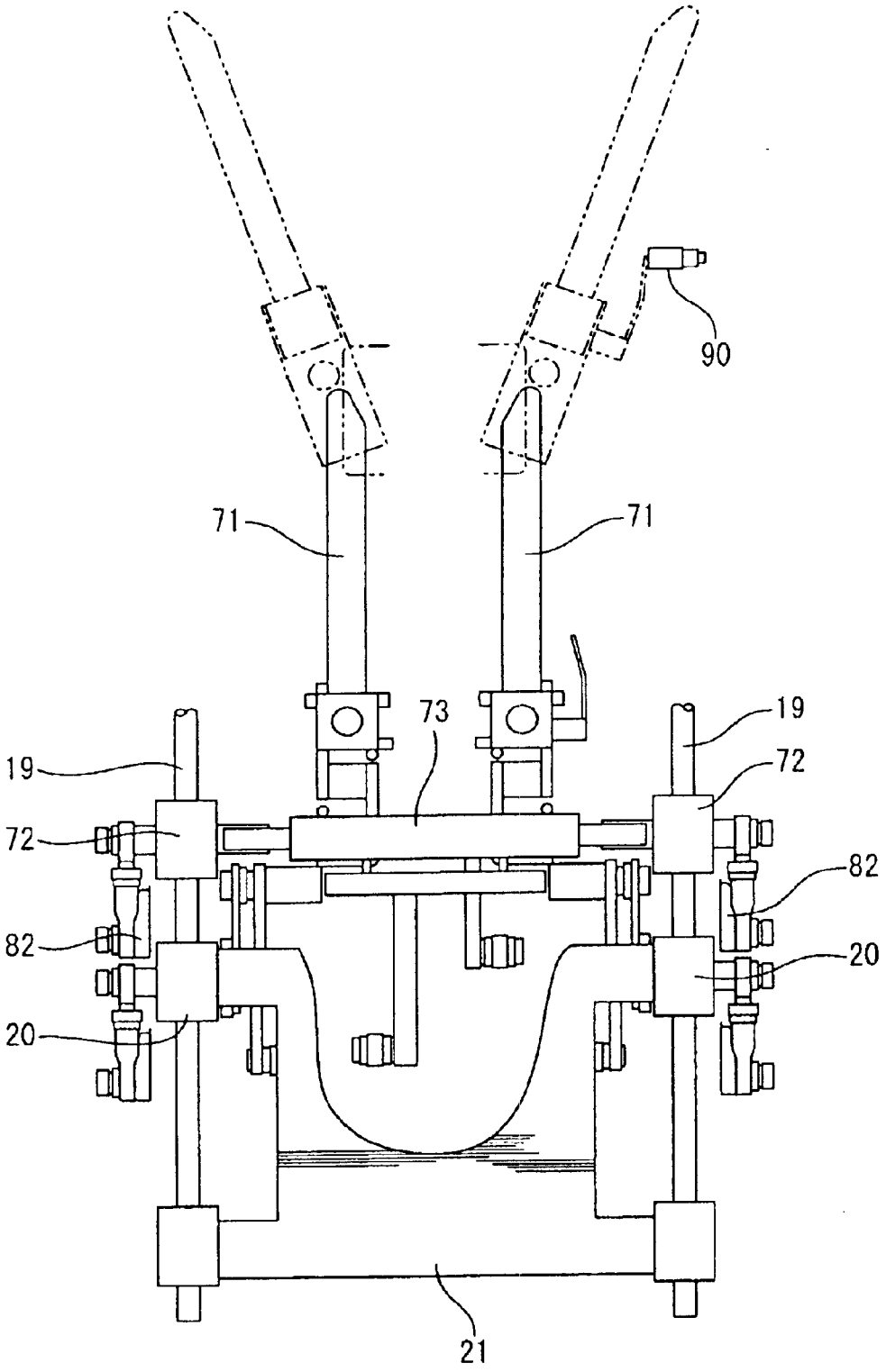
FIG. 16 is a overall illustrative view of FIG. 15.

By means of the lever 82 shown in FIG. 6, the opening and closing bars 71 advance together with the hopper 18 and a separate lever 83 causes the opening and closing bars 71 to gradually become horizontal, as illustrated by the dotted lines 71A. In short, the two opening and closing bars 71 move back and forth on the horizontal guides 19, due to the oscillating movement of the levers 82, as illustrated in FIG. 16, and in this operation, the spanning shaft 73 is rotated by the lever 83 and the opening and closing bars 71 are caused to rock upwards and downwards.

Figure 18:
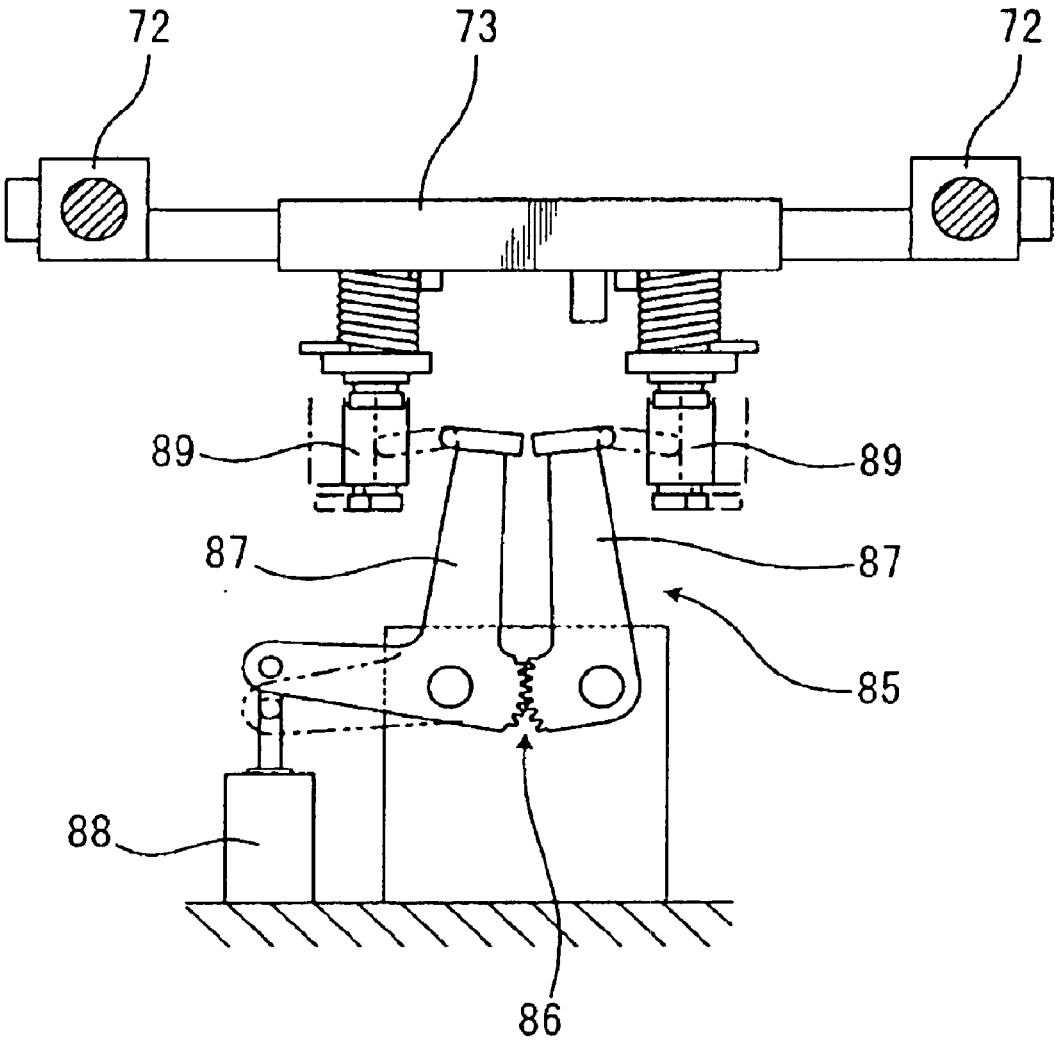
FIG. 18 is an illustrative view of opening and closing bars and a sealing platform.

As illustrated by the dotted lines in FIG. 6, the beak-shaped hopper 18U advances whilst stretching open the mouth of the packaging bag 3, and the front ends of the opening and closing bars 71A halt when they reach a position corresponding to the inner face 84 of the sealing platform 7. Thereafter, an opening and closing device 85 disposed underneath is operated. As shown in FIG. 18, this opening and closing device 85 comprises a pair of rocking bars 87 which mesh mutually in a circular arc shaped tooth section 86, and a driving device 88 for activating the rocker bars 87, which act on descending shafts 89 provided on either side.

In FIG. 14 and FIG. 15, by applying the outward force of the pair of rocker bars 87 to the inner faces of the descending shafts 89 fixed to the rotating plates 75, the two rotating plates 75 are caused to rotate against the elastic force of the coil springs 77, and the opening and closing bars 71 are caused to stretch open the mouth of the packaging bag 3, against the elastic force of the torsion coil spring 78. In order to confirm the present of the packaging bag 3, if the opening and closing bars 71 are not inserted correctly into the mouth of the packaging bag 3 in this situation, then the opening and closing bars 71 will open beyond the prescribed amount and will interfere with a detection switch 90. Upon a signal from the switch 90, the forward and reverse motor 69 illustrated in FIG. 1 will be switched to reverse, and the insertion-bars 11 are withdrawn, whilst leaving the article 2 on the sliding plate 21. In other words, in FIG. 19, if a packaging bag confirmation failure signal caused by the opening and closing bars is issued, then the whole apparatus is halted (S13), and at the same time, a reverse signal (S14) is issued to the insertion motor 69. The aforementioned confirmation of the packaging bag 3 by the opening and closing bars 71 is performed again, the packaging bag confirmation failure signal is output again, and a reverse signal (S15) is issued to the insertion motor. Here, if the stretching resistance of the packaging bag is confirmed twice by the opening and closing bars 71, then the rotation of the insertion motor (S11) is continued and a control return operation is performed.

Figure 10:
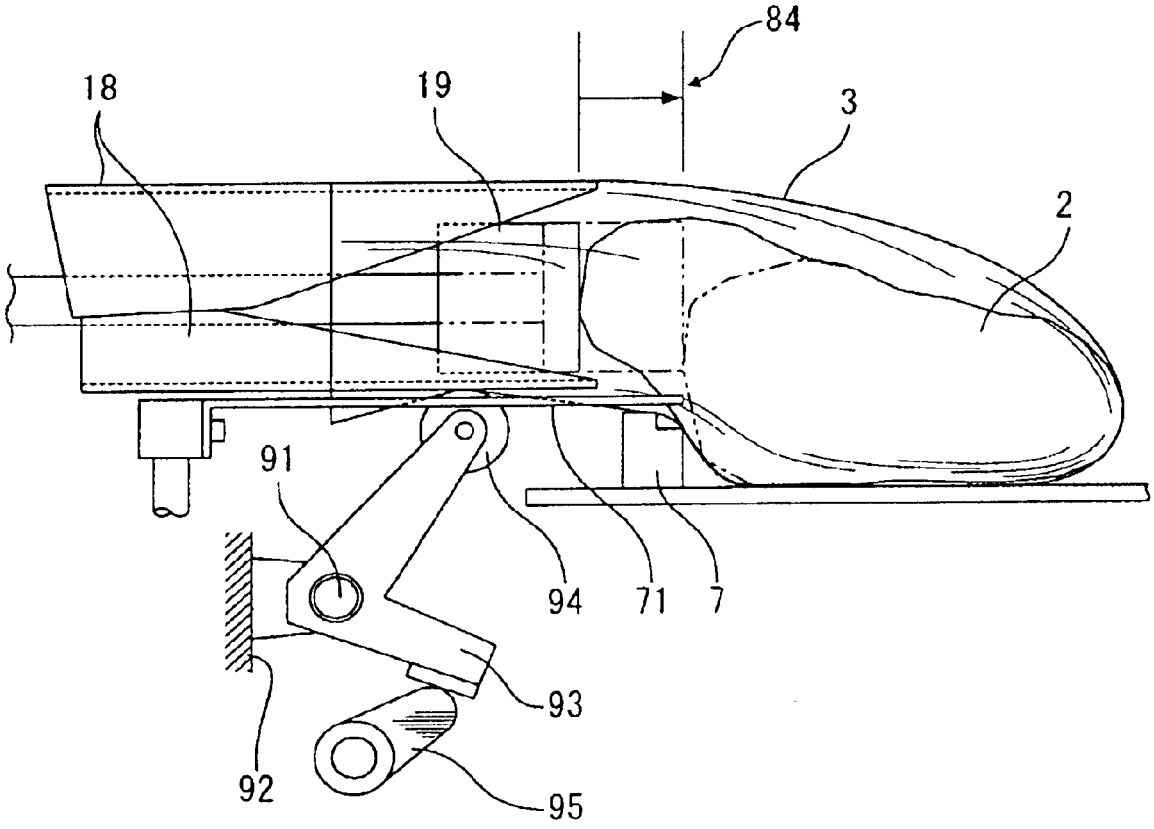
FIG. 10 is an illustrative view of the state of supplying a packaged article to a sealing platform.

FIG. 10 shows a state where the opening and closing bars 71 have confirmed the presence of the packaging bag 3, and the insertion bars 11 have pushed the article 2 inside the packaging bag 3, by continuing operation of the forward and reverse motor 69. In this case, the beak-shaped hopper 18 is advanced whilst stretching open the mouth of the packaging bag 3, and the front ends of the opening and closing bars 71 are halted at a position corresponding to the inner face 84 of the sealing platform 7. Since the packaging bag 3 is caused to swell by means of compressed air injected via the interior of the beak-shaped hopper 18, the insertion bar 11 following the beak-shaped hopper 18 is pushed to a position indicated by the dotted lines which coincides with the inner face 84 of the sealing platform 7, thereby pushing the article 2 inside the packaging bag 3. In this case, a slip wheel type friction element 94 provided on the front end of a rocking member 93 fixed to a frame 92 via a pin 91 presses on the under side of the packaging bag 3, by means of a rotating cam 95. This serves to prevent the packaging bag 3 from falling out-of the beak-shaped hopper 18 due to the momentum of the article 2, and by means of this operation, the packaging bag 3 is pulled and extended by the insertion of the article 2, thereby having the effect of reducing the extra space inside the packaging bag.

Figure 17:
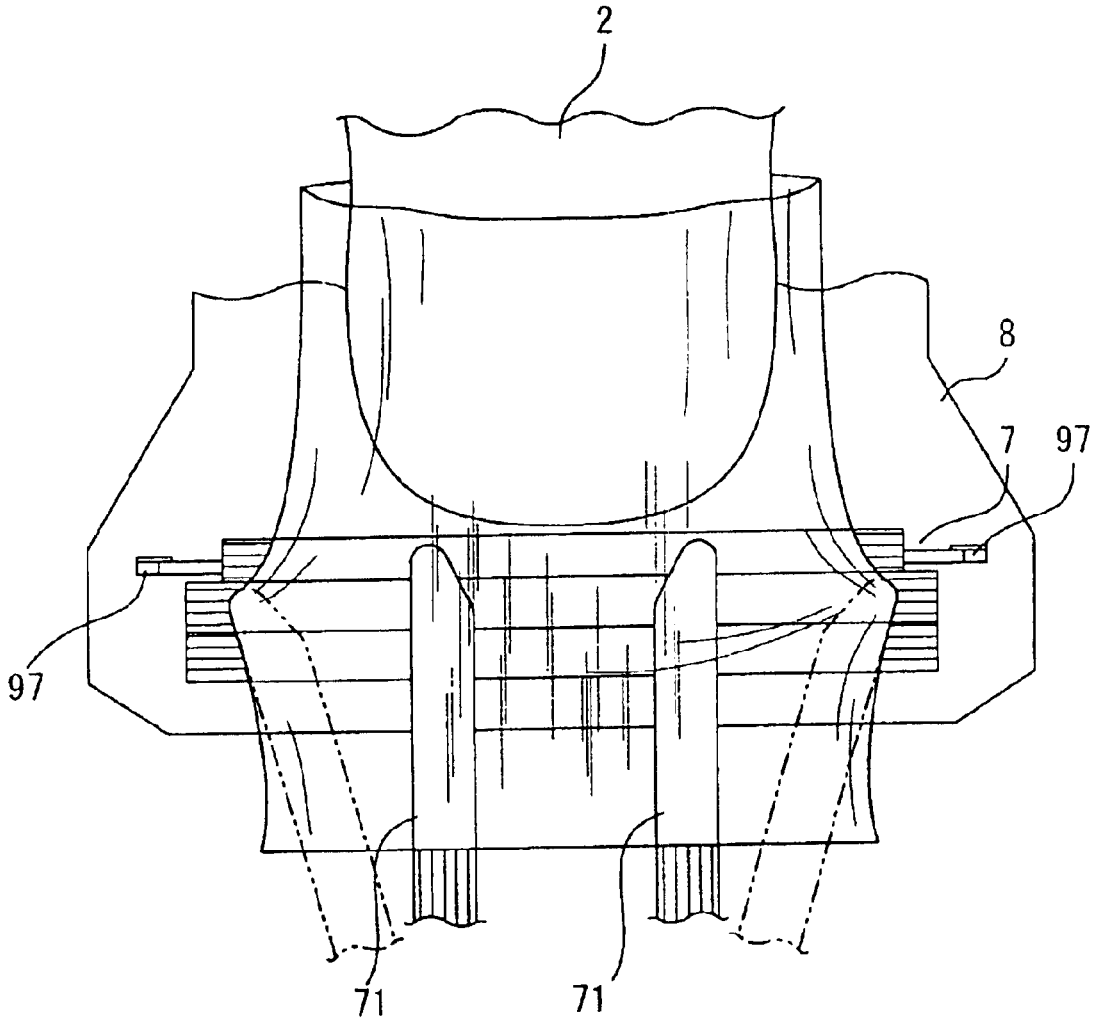
FIG. 17 is an illustrative view of an opening and closing device for the opening and closing bars.

As shown in FIG. 5, if the cam rail 34 is inclined about the pin 37, then the upper groove member 25 rotates as indicated by the arrow 96, and the beak-shaped hopper 18 is removed from the packaging bag in this state. In this case, the opening and closing bars 71 in FIG. 10 remain in this state, and as shown in FIG. 17 the bars 71 cause the mouth of the packaging bag 3 to stretch on both sides, again, the stretched open mouth of the bag then being pushed to the sealing platform 7 by holding claws 97 on either side thereof, and the opening and closing bars 71 being withdrawn in order to continue their operational cycle.

When the air in the packaging bag 3 containing the article and mounted on the fixed plate 8 of the rotary vacuum packaging machine has been reduced to a vacuum state in the pressure chamber 6, the cylinder and diaphragm 10 are actuated and the opening section is heat sealed by a sealing bar.

What is claimed is:

1. A packaging system in which a portion of a winding path of a taped bag, formed by attaching openings of respective bags stacked in a scale-like fashion onto an adhesive tape, is formed horizontally, the opening of the foremost packaging bag hanging down from the adhesive tape in the horizontal portion of the travel path is pulled downwards and opened by vacuum cups, a beak-shaped hopper which opens in the upward and downward direction is inserted inside the opening of the packaging bag, the packaging bag is peeled off from the adhesive tape, an article to be packaged is accommodated inside the packaging bag via the hopper by means of an insertion rod which follows the course of the hopper, and the opening of the packaging bag is sealed after the packaging bag is placed in a vacuum state by means of a rotary vacuum packaging machine;

the packaging system comprising:

means for limiting the amount of movement of the respective front ends of the hopper and the insertion rod to a position up to the inner side of a circulating sealing platform;

means for restricting the sliding motion of the packaging bag by pressing the opening of the bag against the hopper by means of a frictional element which presses on the under side of the hopper;

means for blowing compressed air injected onto the upper face of the hopper, inside the packaging bag along the upper face of the hopper, and also blowing the air inside the packaging bag via the interior of the hopper as the hopper advances; and means for advancing a pair of opening and closing bars provided below the hopper, integrally with the hopper to a limit region, and temporarily standing by in the region after the hopper has been withdrawn, and causing the opening of the packaging bag to be stretched along the sealing platform by opening in opposite directions during a standby period.

2. The packaging system according to claim 1, further comprising a sensor for detecting the opening of the foremost packaging bag hanging down from the adhesive tape in the horizontal portion of the travel path, and an inching feed motor for the taped bag, wherein the front end of a packaging bag inched forward is detected by the sensor, and a vacuum suction pressure is applied to vacuum cups for sticking to the opening of the foremost packaging bag hanging down from the adhesive tape.

3. The packaging system according to claim 2, wherein a vacuum gauge is provided in a vacuum line for applying a vacuum suction pressure to the vacuum cups, and when a value read by the vacuum gauge rises, this is taken as a standby signal to start a forward operation of an insertion motor, and a forward operation start signal for the insertion motor is issued in connection with an article-to-be-packaged supply signal generated when the article to be packaged is detected by the first sensor.

4. The packaging system according to claim 2, wherein a signal for switching a plurality of cases is issued in a line for carrying in articles to be packaged, when a confirmation failure signal issued by a sensor for detecting the front end of the inched forward packaging bags passes over a set period of time.

5. The packaging system according to claim 1, wherein the hopper and the opening and closing bars constantly perform reciprocal movement between a loading table for articles to be packaged and a circulating sealing platform, using a motive force of the sealing platform, and after supplying the article on a belt conveyor onto the loading table, in response to a signal from a sensor for detecting an arrival of the article conveyed by the belt conveyor, the forward operation of an insertion motor is started in synchronism with the reciprocal movement of the hopper, and the article starts following the hopper by means of the insertion rod.

6. The packaging system according to claim 5, wherein the opening and closing bars, together with the hopper, are opened in a position where they are pushed to the inner face of the sealing platform which stops intermittently whilst circulating, and the opening of the packaging bag is stretched open by the opening action, thereby detecting the presence of the packaging bag.

7. The packaging system according to claim 6, wherein unrestricted opening of the opening and closing bars is detected by a sensor, and a reverse signal is issued to the insertion motor in accordance with the detected signal.

* * * * *